US006694903B1

(12) United States Patent
Chen

(10) Patent No.: US 6,694,903 B1
(45) Date of Patent: Feb. 24, 2004

(54) KNIFE TRACK ADJUSTMENT STRUCTURE OF THREAD CUTTER OF SEWING MACHINE

(75) Inventor: Shih-Fang Chen, Taipei (TW)

(73) Assignee: Ching Chi Machine Co., Ltd., Taipei Hsieng (TW)

( * ) Notice: Subject to any disclaimer, the term of this patent is extended or adjusted under 35 U.S.C. 154(b) by 0 days.

(21) Appl. No.: 10/319,648

(22) Filed: Dec. 16, 2002

(51) Int. Cl.[7] ..... D05B 65/00
(52) U.S. Cl. ..... 112/298
(58) Field of Search ..... 112/298, 292, 112/296, 297, 291, 285, 288

(56) References Cited

U.S. PATENT DOCUMENTS 5,469,798 A 11/1995 Gauch
5,481,994 A 1/1996 Ku
5,775,246 A * 7/1998 Lin ..... 112/292
5,870,962 A 2/1999 Ku
5,887,535 A 3/1999 Yu
6,021,727 A 2/2000 Ku
6,205,941 B1 3/2001 Yu
6,234,097 B1 5/2001 Ku
6,378,448 B1 4/2002 Huang

* cited by examiner

*Primary Examiner*—Peter Nerbun
(74) *Attorney, Agent, or Firm*—Rosenberg, Klein & Lee

(57) ABSTRACT

A knife track adjustment structure of a thread cutter of a sewing machine includes a front guide board bridged over the base board with an upper and a lower ends of the front guide board locked on the base board. The front guide board up and down adjustably displaceable on the base board. A guide is disposed under the middle section of the front guide board, a guide pin being sequentially passed through a hook rod arm and a knife arm. A swing arm, a first end of the swing arm being pivotally connected with the base board, a pin being connected with the bottom of a second end of the swing arm. The pin is sequentially passed through the hook rod arm and pivotally connected on the knife arm. A spring compressed between the swing arm and the base board helps in restoring the knife arm and hook rod arm.

5 Claims, 7 Drawing Sheets

KNIFE TRACK ADJUSTMENT STRUCTURE OF THREAD CUTTER OF SEWING MACHINE

BACKGROUND OF THE INVENTION

1. Field of the Invention

The present invention is related to a knife track adjustment structure of thread cutter of a sewing machine. A front guide board of a swing arm is up and down adjustably displaceable on the base board, whereby the position of a thread cutter composed of a knife arm and a hook rod arm can be drivingly adjusted so as to rectify the movement track of the thread cutter. A spring is compressed between the swing arm and the base board to help in restoring the thread cutter.

2. Description of the Prior Arts

U.S. Pat. No. 6,234,097 discloses a thread cutter of sewing machine. The thread cutter includes a fixed plate 1, a knife arm 2, a hook rod arm 3, a cantilever assembly 4 and cooperative conventional securing member 63, cutting knife 64, hook rod 66 and swing arm 67. The periphery of the fixed plate 1 is formed with locating holes for mounting the fixed plate 1 on the sewing machine. The fixed plate 1 is formed with a mounting recess 12 in which one end of the knife arm 2 is placed. The other end of the knife arm 2 is formed with perforations 23 and thread holes 24 for mounting the securing member 63 and the cutting knife 64. The hook rod arm 3 is formed with left and right slots 31, 32 and a notch 33. One end of the swing arm 67 is placed in the notch 33 for driving the hook rod arm 3 to displace. The tail end of the hook rod arm 3 is assembled with the hook rod 66. In cooperation with the securing member 63 and the cutting knife 64, the thread cutter can perform thread cutting operation.

The thread cutter is characterized in that the cantilever assembly 14 is composed of a left and a right cantilevers 41, 42 and fixed with the fixed plate 1. The left cantilever 42 has a downward directed projecting post 423 placed in the left slot 32 of the hook rod arm 3. The projecting post 413 of the right cantilever 41 is inserted in the perforation 26 of the lug 25 of the knife arm 2. The projecting post 413 serves as a fulcrum about which the knife arm 2 swings so as to greatly reduce the swinging torque of the hook rod arm 3 and knife arm 2. The tail end of the knife arm 2 is formed with a slot 22. The projecting post 35 under the tail end of the hook rod arm 3 is placed in the slot 22, whereby the hook rod arm 3 can more stably operate to enhance the quality of the thread cutting operation.

However, the above thread cutter structure has some shortcomings as follows:

1. The left cantilever 42 is substantially N-shaped. One leg of the left cantilever 42 is locked on the fixed plate 1, while the other leg is cantilevered. The bottom end of the cantilevered leg has a projecting post 423 placed in the left slot 32 of the hook rod arm 3. When the hook rod arm 3 or the knife arm 2 slides, due to rubbing, the cantilevered leg of the left cantilever 42 often co-vibrates. This makes it impossible for the hook rod arm 3 or knife arm 2 to operate in a smooth move track or even a noise is produced.

2. When the swing arm 67 restores the knife arm 2 and hook rod arm 3, due to the gap between the respective components, such as the gap between the swing arm 67 and the notch 33 of the hook rod arm 3, the knife arm 2 and the hook rod arm 3 often cannot be accurately restored. This results in inaccurate thread cutting operation.

3. The bending section 321 of the left slot 32 of the hook rod arm 3 is continuously rubbed by the projecting post 423 of the left cantilever 42 and is widened. This leads to enlarged gap between the projecting post 423 and the bending section 321. Accordingly, the thread cutting operation can be hardly accurately performed.

4. The projecting post 413 of the left cantilever 42 placed in the left slot 32 of the hook rod arm 3 is spaced from the fixing point where the left cantilever 42 is fixed on the fixed plate 1. That is, a force arm exists. When the hook rod arm 3 reciprocally slides, the bending section 321 of the left slot 32 will collide the projecting post 413. The action force multiplies the force arm to produce a bending torque onto the fixing point where the left cantilever 42 is fixed on the fixed plate 1. As a result, the left cantilever 42 is very easy to loosen and detach.

In addition, U.S. Pat. Nos. 5,469,798, 5,481,994, 5,870,962, 5,887,535, 6,021,727, 6,205,941 and 6,378,448 disclose other thread cutter structures.

SUMMARY OF THE INVENTION

It is therefore a primary object of the present invention to provide a knife track adjustment structure of thread cutter of sewing machine. By means of up and down adjusting the guide seat or the swing arm on the lower shaft inner cover, the positions of the thread cutter composed of the fixed knife seat and movable knife seat can be drivingly adjusted so as to rectify the movement track of the thread cutter.

It is a further object of the present invention to provide the above knife track adjustment structure of thread cutter of sewing machine in which the guide seat is a straight plate and upper and lower ends of the guide seat are firmly fixed on the lower shaft inner cover. When the thread cutter operates, the guide seat will not vibrate or co-vibrate as the conventional cantilever structure. Therefore, the movement track is smoothened and no noise or vibration will be produced.

It is still a further object of the present invention to provide the above knife track adjustment structure of thread cutter of sewing machine in which a spring is mounted between the lower shaft inner cover and the swing arm to restore the thread cutter to predetermined position so as to avoid inaccurate thread cutting operation.

According to the above objects, the thread cutter of sewing machine of the present invention includes a lower shaft inner cover over which a fixed knife seat is bridged. A movable knife seat is bridged over the fixed knife seat. The movable knife seat is driven by a driving arm to stably axially slide on the fixed knife seat. The knife track adjustment structure includes: a guide seat bridged over the lower shaft inner cover, an upper and a lower ends of the guide seat being locked on the lower shaft inner cover, the guide seat being up and down adjustably displaceable on the lower shaft inner cover, whereby the fixed knife seat and a middle section of the movable knife seat bridged over the fixed knife seat are permitted to slide between the guide seat and the lower shaft inner cover, a guide spacer ring being disposed under the middle section of the guide seat, the guide spacer ring being sequentially passed through a first guide slot of the movable knife seat and a guide slot of the fixed knife seat; and a swing arm, a first end of the swing arm being pivotally connected with the lower shaft inner cover, a spacer ring being disposed under the bottom of the second end of the swing arm, the spacer ring being sequentially passed through a second guide slot of the movable knife seat and pivotally connected on the fixed knife seat, a spring being compressed between the swing arm and the lower shaft inner cover to help in restoring the fixed knife seat and movable knife seat.

The present invention can be best understood through the following description and accompanying drawings wherein:

DETAILED DESCRIPTION OF THE PREFERRED EMBODIMENTS

Figure 1:
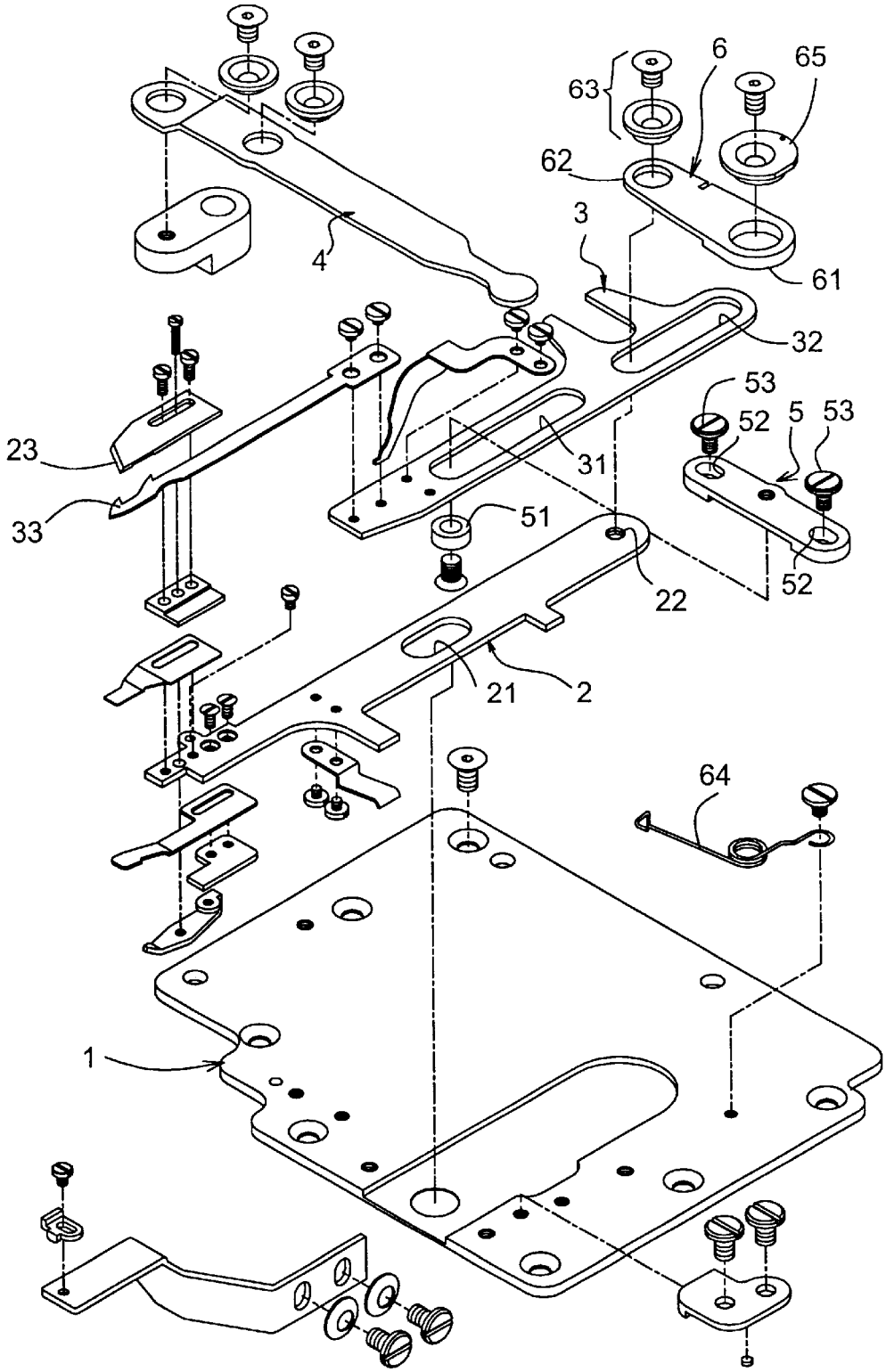
FIG. 1 is a perspective exploded view of the present invention.

Please refer to FIGS. 1 to 7. The thread cutter 100 of the present invention includes a lower shaft inner cover 1 over which a fixed knife seat 2 is bridged. A movable knife seat 3 is bridged over the fixed knife seat 2. The movable knife seat 3 is driven by a driving arm 4 to stably axially slide on the fixed knife seat 2. The knife track adjustment structure of the present invention includes: a guide seat 5 bridged over the lower shaft inner cover 1 with an upper and a lower ends of the guide seat 5 screwed on the lower shaft inner cover 1, the guide seat 5 being up and down adjustably displaceable on the lower shaft inner cover 1, the fixed knife seat 2 and the middle section of the movable knife seat 3 bridged over the fixed knife seat 2 being permitted to slide between the guide seat 5 and the lower shaft inner cover 1, a guide spacer ring 51 being disposed under the middle section of the guide seat 5, the guide spacer ring 51 being sequentially passed through a first guide slot 31 of the movable knife seat 3 and a guide slot 21 of the fixed knife seat 2; and a swing arm 6, a first end 61 of the swing arm 6 being pivotally connected with the lower shaft inner cover 1, a spacer ring 63 being connected with the bottom of a second end 62 of the swing arm 6, the spacer ring 63 being sequentially passed through a second guide slot 32 of the movable knife seat 3 and pivotally connected on a perforation 22 of the fixed knife seat 2. A spring 64 is compressed between the swing arm 6 and the lower shaft inner cover 1 to help in restoring the fixed knife seat 2 and movable knife seat 3. The guide seat 5 or swing arm 6 can be up and down adjustably displaced on the lower shaft inner cover 1 to drivingly adjust the position of the thread cutter 100 composed of the fixed knife seat 2 and movable knife seat 3. Accordingly, the movement track of the thread cutter of the sewing machine can be rectified.

Figure 2:
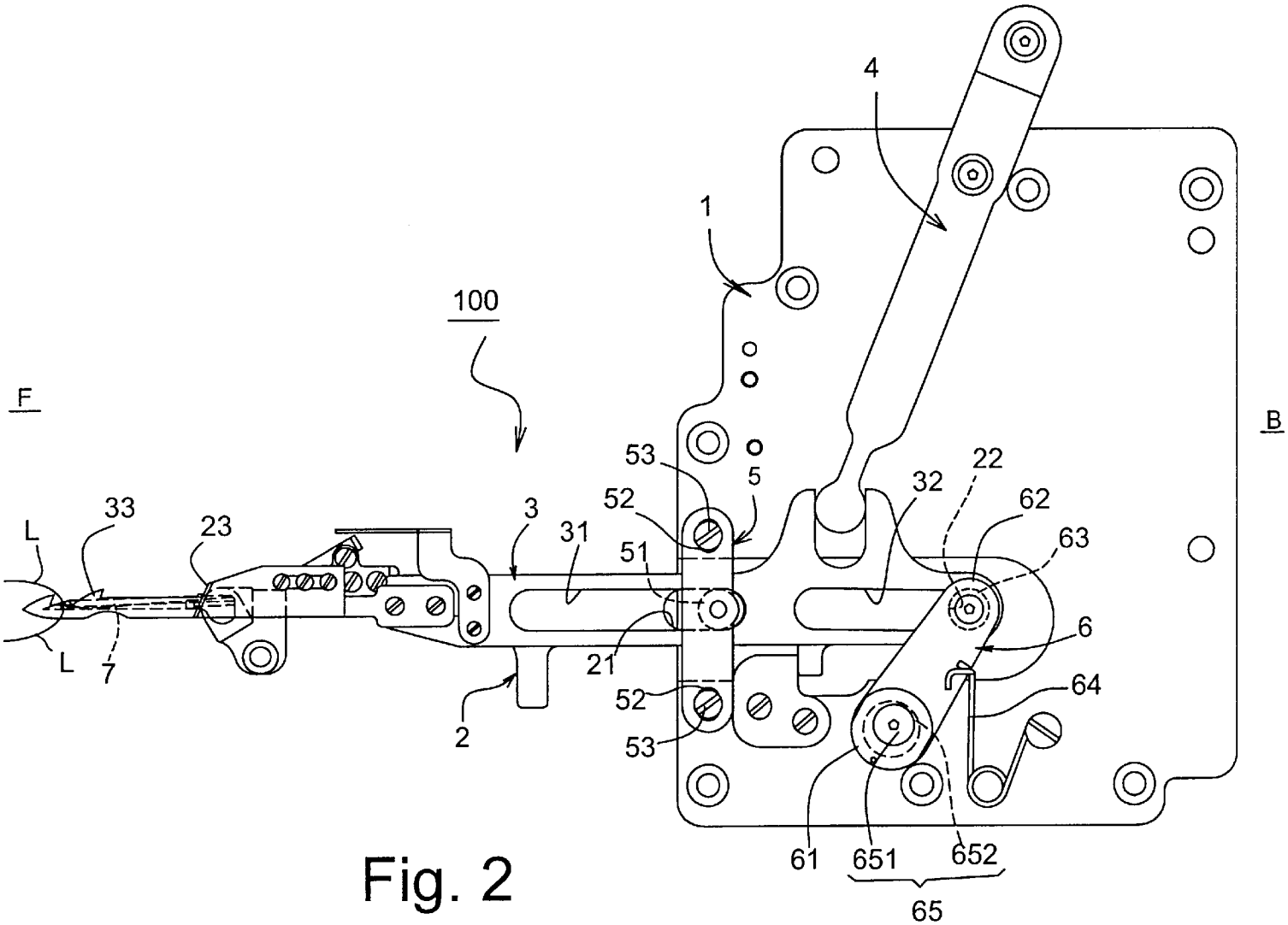
FIG. 2 is a plane assembled view of the present invention.
Figure 3:
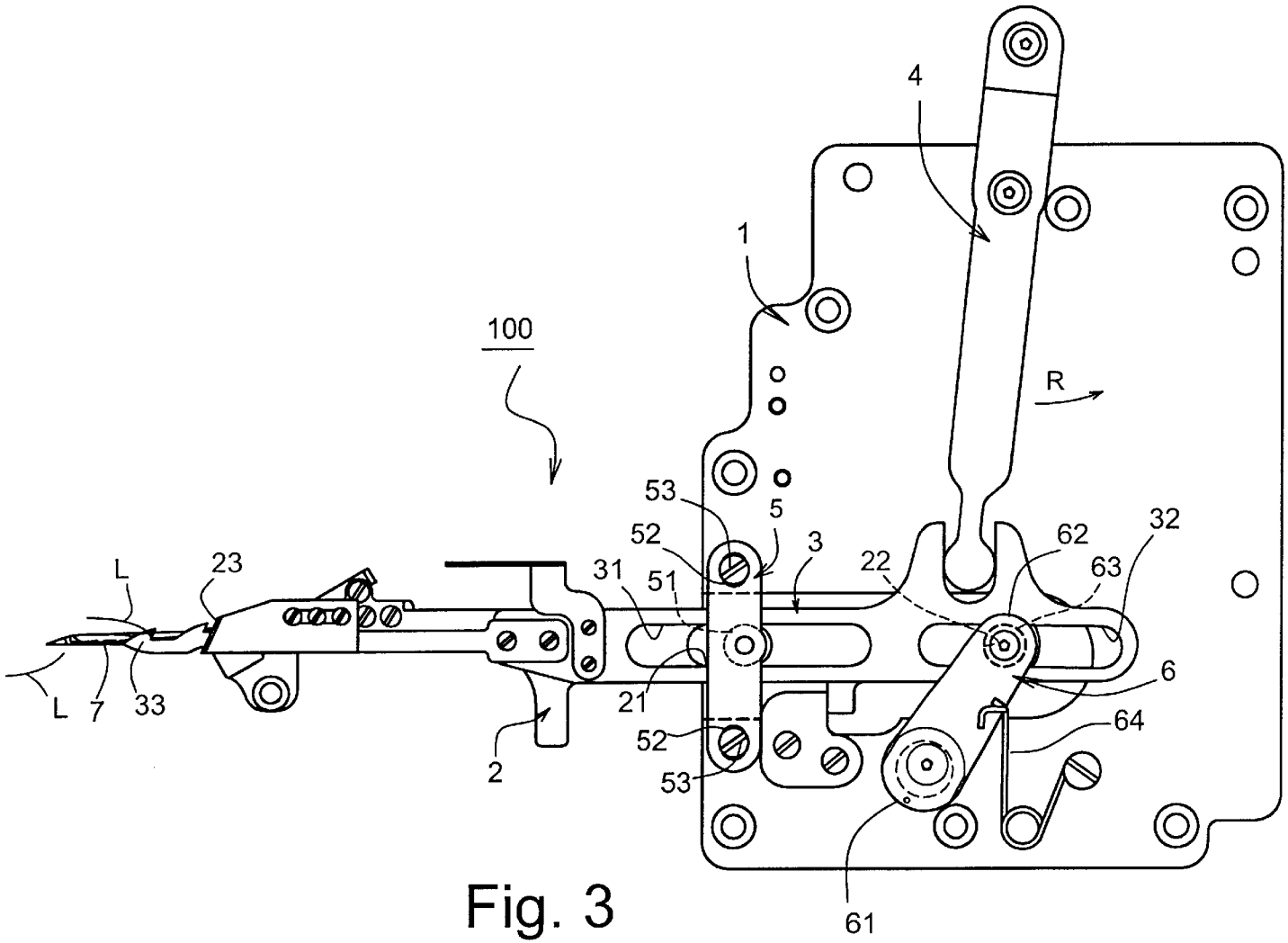
FIG. 3 is a plane view according to FIG. 2, in which the movable knife seat is micro-retreated.
Figure 4:
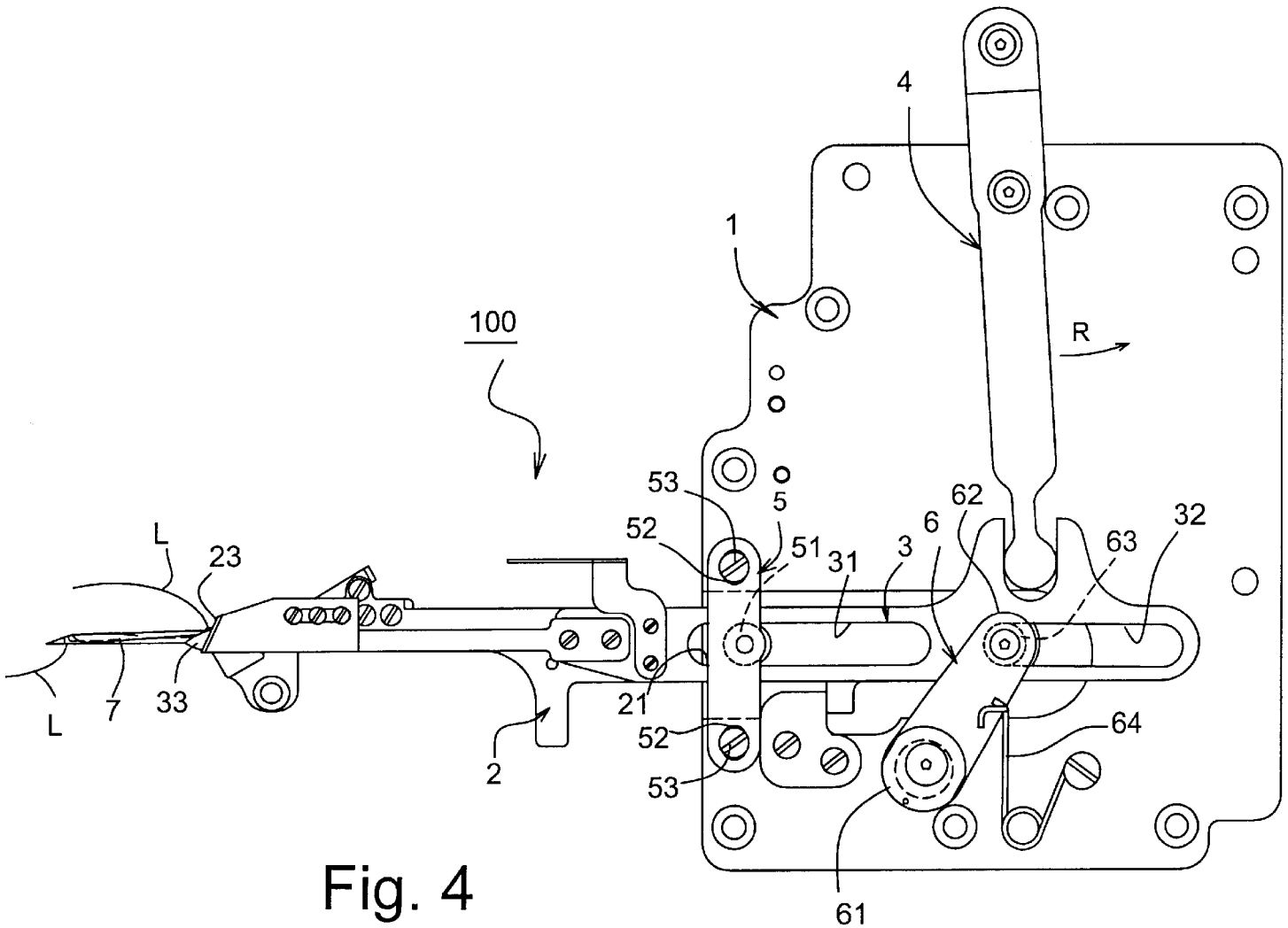
FIG. 4 is a plane view showing that the thread cutter cuts off a thread.
Figure 5:
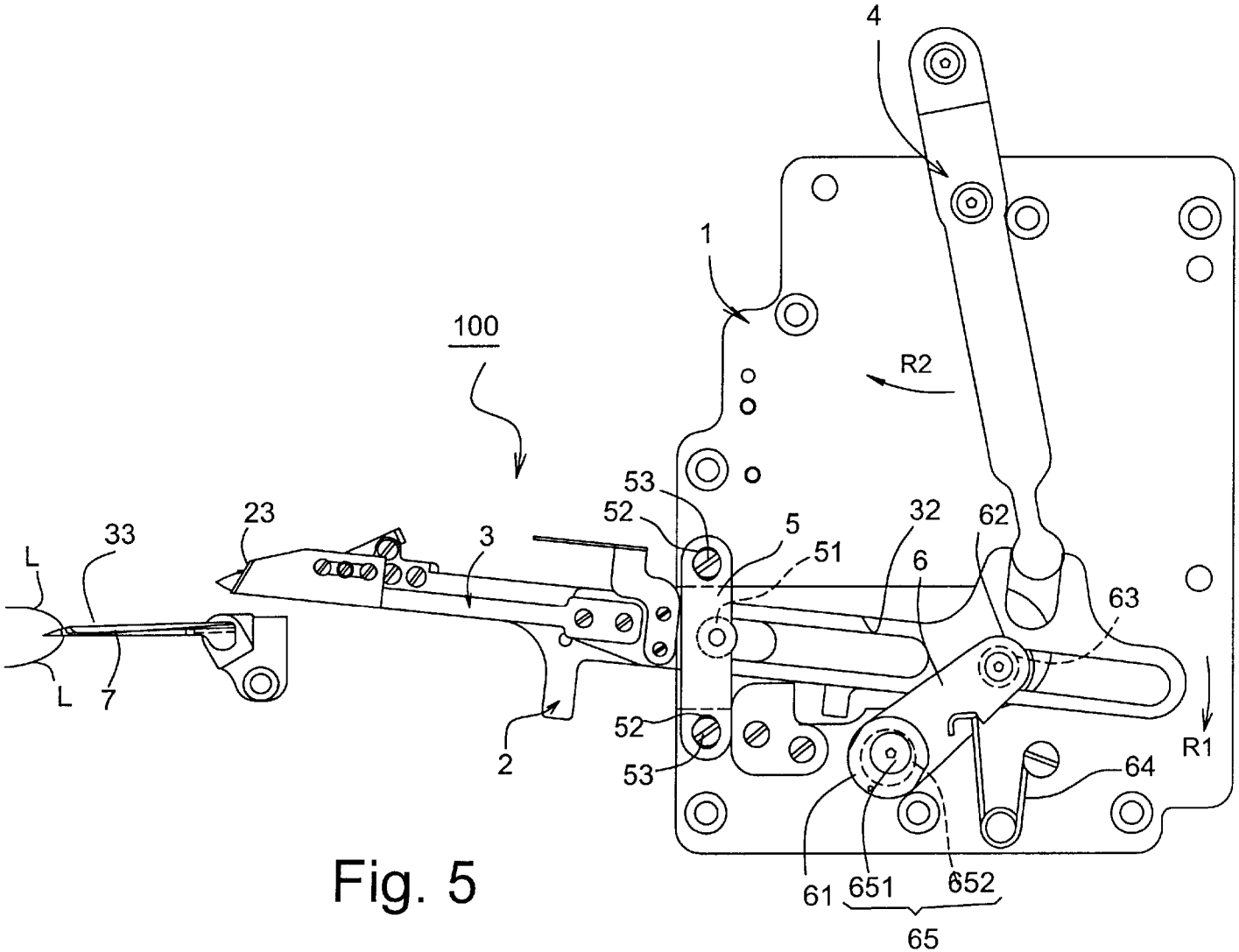
FIG. 5 is a plane view showing that the thread cutter is turned upward.

In operation, the driving arm 4 of the thread cutter 100 of the present invention is biased from a state of FIG. 2 to backward B move the movable knife seat 3, that is, the movable knife 33 connected with front end F of the movable knife seat 3 is drivingly retreated, whereby the hook section of the movable knife 33 can hook and move the stitching thread L backward as shown in FIG. 3. When the driving arm 4 is further biased in direction R, the movable knife 33 is further drivingly retreated, whereby the movable knife 33 and the fixed knife 23 at front end of the fixed knife seat 2 intersect each other to shear off the stitching thread L as shown in FIG. 4. After cutting off the thread, the driving arm 4 further drives the movable knife seat 3 in direction R. At this time, the front edge of the second guide slot 32 of the movable knife seat 3 backward drives the spacer ring 63 of the swing arm 6, whereby with the pivot center of the swing arm 6 and the lower shaft inner cover 1 as the center, spacer ring 63 drives and turns the fixed knife seat 2 in direction R1. (The fixed knife seat 2 is biased about the guide spacer ring 51 of the guide seat 5. ) At the same time, the spring 64 and the fixed knife seat 2 and the front end of the movable knife 33 of the thread cutter 100 are biased from the upper side of a lower thread hooker 7 so as not to interfere with the normal operation of the lower thread hooker 7 as shown in FIG. 5. In next thread cutting operation, the driving arm 4 is biased and turned in direction R2 to drive the movable knife seat 3 and the movable knife 33 to slide forward. At this time, the compressed spring 64 resiliently restores to drive the swing arm 6 and make the spacer ring 63 drivingly bias the fixed knife seat 2 about the guide spacer ring 51 of the guide seat 5 to restore to the state as shown in FIG. 3.

Figure 6:
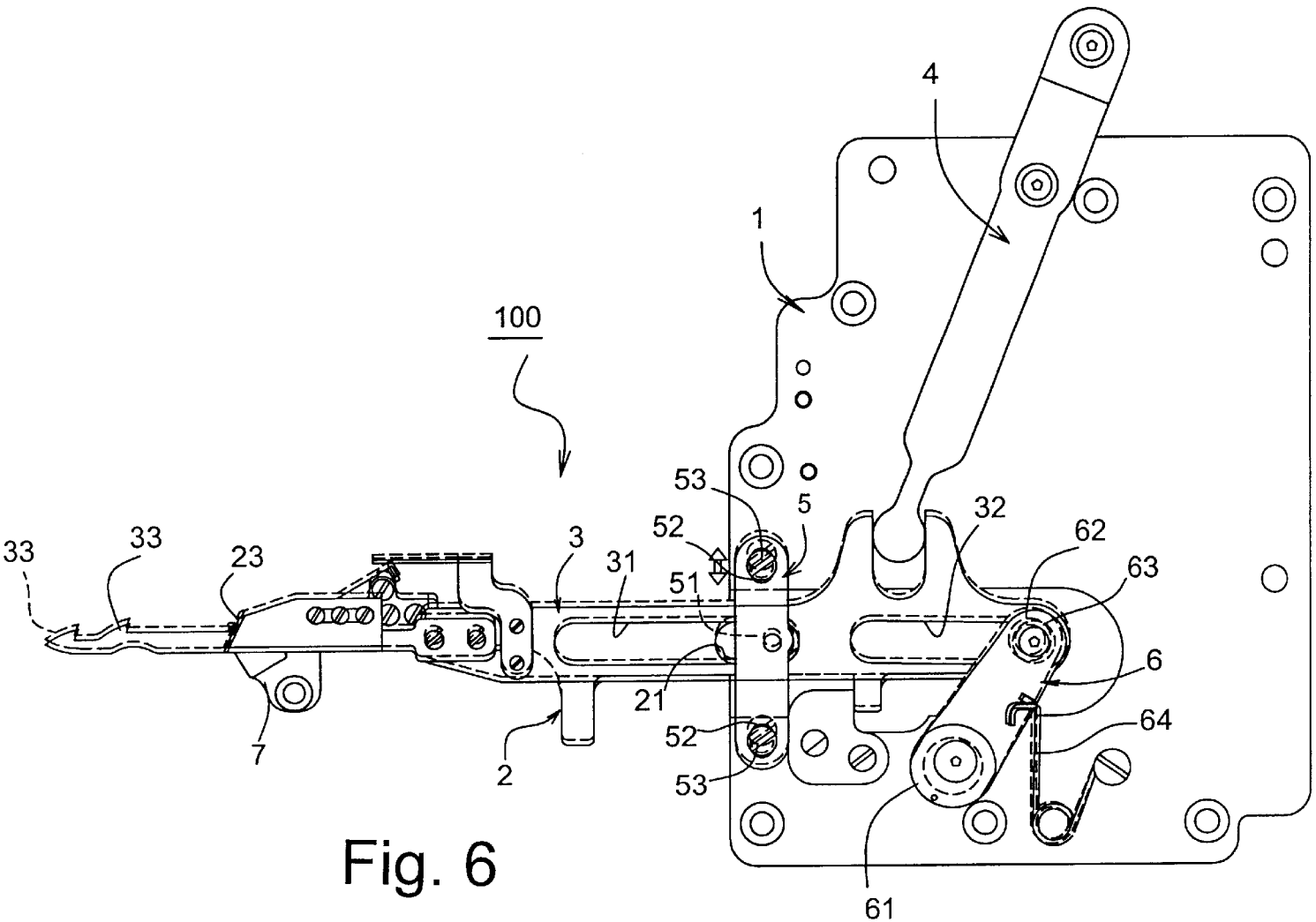
FIG. 6 is a plane view showing that the guide seat is micro-adjusted.

The guide seat 5 is a straight plate. A guide spacer ring 51 is disposed under the bottom of middle section of the guide seat 5. The upper and lower ends of the guide seat 5 are respectively formed with two adjustment slots 52. Screws 53 are passed through the adjustment slots 52 to lock the guide seat 5 on the lower shaft inner cover. Accordingly, by means of the adjustment slots 52, the guide seat 5 is up and down adjustably locked on the lower shaft inner cover 1 as shown in FIG. 6. After the guide seat 5 is upward moved and adjusted, the guide spacer ring 51 will drivingly upward move the fixed knife seat 2 and the movable knife seat 3. After adjusted, the position of the movable knife 33 is as shown by phantom line of FIG. 6. Reversely, after the guide seat 5 is downward moved and adjusted, the guide spacer ring 51 will drivingly downward move the fixed knife seat 2 and the movable knife seat 3 to rectify the position of the movable knife 33.

The guide spacer ring 51 is disposed at the center of the guide seat 5 and aligned with the screws 53 for locking the guide seat 5. Therefore, when the thread cutter operates, almost no torque is produced on the guide spacer ring 51. This reduces the possibility of loosening or detachment of the guide seat 5. Moreover, the guide seat 5 is a straight plate and the upper and lower ends of the guide seat 5 are locked on the lower shaft inner cover 1. Therefore, the guide seat 5 is not a cantilever. When the thread cutter operates, no vibration or noise is produced and the movement track of the thread cutter is smoother.

Figure 7:
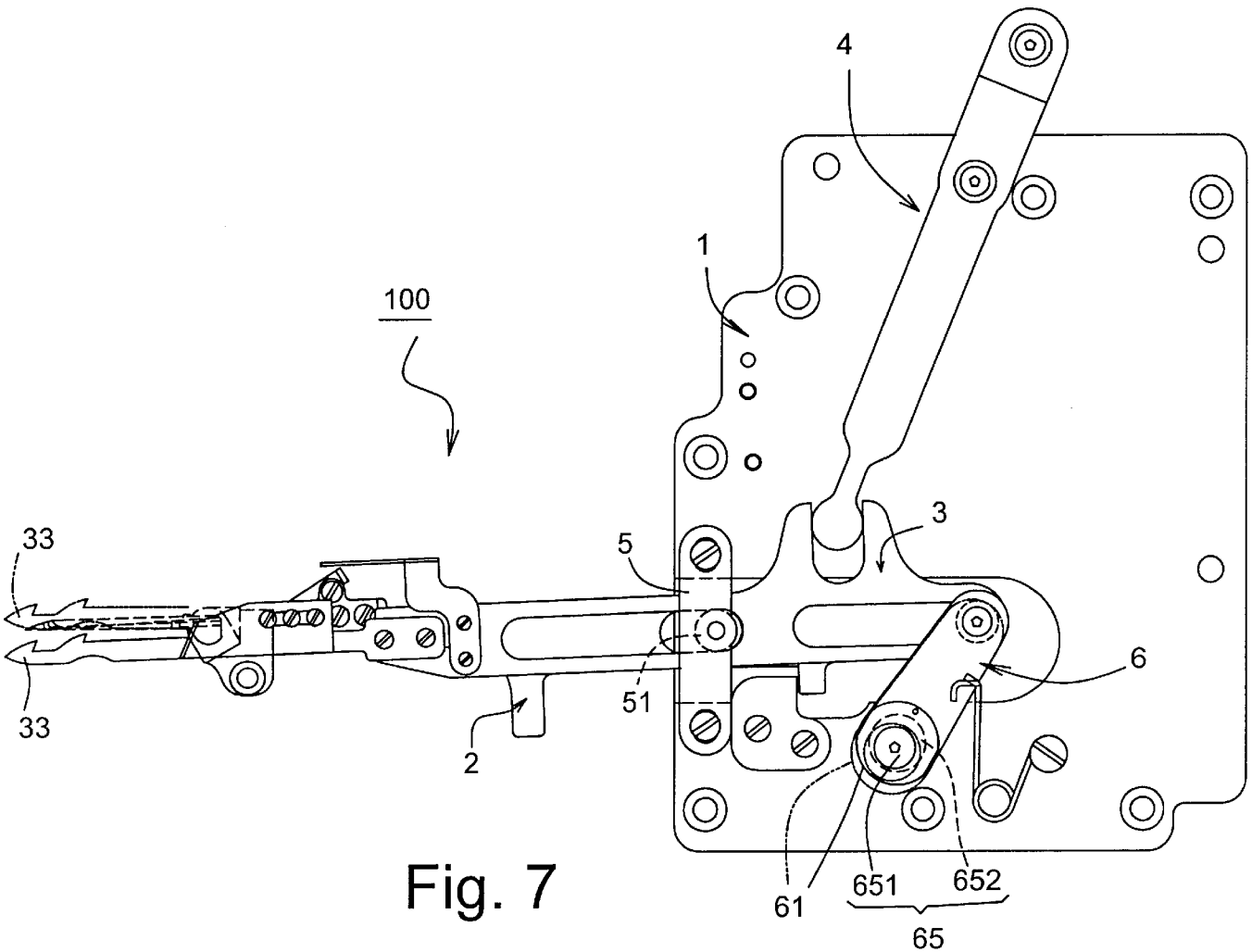
FIG. 7 is a plane view showing that the swing arm is micro-adjusted.

The first end 61 of the swing arm 6 is fitted on an eccentric adjustment spacer ring 65 which has a first shaft section 651 fixedly connected with the lower shaft inner cover 1 and a second shaft section 652 axially eccentrically disposed at top end of the first shaft section 651. The second shaft section 652 is pivotally connected with the first end 61 of the swing arm 6. Accordingly, by means of turning the eccentric adjustment spacer ring 65 to adjust the angle thereof ( as shown in FIG. 7 from phantom line to solid line ), the swing arm 6 is driven to adjust the position of the swing arm 6. At this time, the swing arm 6 will drivingly bias the fixed knife seat 2 and movable knife seat 3 about the guide spacer ring 51 of the guide seat 5 so as to rectify the position of the movable knife 33 mounted at front end of the movable knife seat 3.

The first shaft section 651 can be a bolt or spacer ring eccentrically axially fitted through the eccentric adjustment spacer ring 65.

By means of the guide seat 5 or swing arm 6, the positions of the fixed knife seat 2 and movable knife seat 3 and the movable knife 33 so as to adjust and rectify the movement track of the thread cutter.

The knife track adjustment structure of thread cutter of sewing machine of the present invention has the following advantages:

1. The upper and lower ends of the guide seat 5 are firmly fixed on the lower shaft inner cover 1. When the thread cutter operates, the guide seat 5 will not vibrate or co-vibrate as the conventional cantilever structure. Therefore, the operation of the thread cutter is smoothened.

2. By means of adjusting the guide seat 5 or the swing arm 6, the positions of the fixed knife seat 2 and movable knife seat 3 and the movable knife 33 of the thread cutter can be cooperatively adjusted to meet the requirement of an operator.

3. The guide seat 5 will not vibrate or co-vibrate so that the parts of the thread cutter will not loosen or detach.

4. The spring mounted between the lower shaft inner cover 1 and the swing arm 6 can restore the thread cutter to a predetermined position so as to avoid inaccurate thread cutting operation.

The above embodiments are only used to illustrate the present invention, not intended to limit the scope thereof. Many modifications of the above embodiments can be made without departing from the spirit of the present invention.

What is claimed is:

1. A knife track adjustment structure of a thread cutter of a sewing machine, the thread cutter comprising a lower shaft inner cover over which a fixed knife seat is bridged, a movable knife seat being bridged over the fixed knife seat, a movable knife being connected with a front end of the movable knife seat, the movable knife seat being driven by a driving arm to stably slide on the fixed knife seat, whereby after the movable knife hooks a stitching thread, the movable knife intersects the fixed knife to shear off the stitching thread, the knife track adjustment structure comprising:

(a) a guide seat bridged over the lower shaft inner cover, upper and a lower ends of the guide seat being respectively formed with two adjustment slots, screws being passed through the adjustment slots to lock the upper and lower ends of the guide seat on the lower shaft inner cover, whereby the guide seat is up and down adjustably displaceable on the lower shaft inner cover, the fixed knife seat and a middle section of the movable knife seat bridged over the fixed knife seat being permitted to slide between the guide seat and the lower shaft inner cover, a guide spacer ring being disposed under the middle section of the guide seat, the guide spacer ring being sequentially passed through a first guide slot of the movable knife seat and a guide slot of the fixed knife seat; and (b) a swing arm, a first end of the swing arm being pivotally connected with the lower shaft inner cover, a spacer ring being connected with the bottom of a second end of the swing arm, the spacer ring being sequentially passed through a second guide slot of the movable knife seat and pivotally connected on the fixed knife seat, a spring being compressed between the swing arm and the lower shaft inner cover to help in restoring the fixed knife seat and movable knife seat.

2. The knife track adjustment structure of the thread cutter of the sewing machine as claimed in claim 1, wherein a first end of the swing arm is fitted on an eccentric adjustment spacer ring which has a first shaft section fixedly connected with the lower shaft inner cover and a second shaft section axially eccentrically disposed at the top end of the first shaft section, the second shaft section being pivotally connected with the first end of the swing arm.

3. The knife track adjustment structure of the thread cutter of the sewing machine as claimed in claim 2, wherein the first shaft section is a bolt or spacer ring eccentrically axially fitted through the eccentric adjustment spacer ring.

4. A knife track adjustment structure of a thread cutter of a sewing machine, the thread cutter comprising a lower shaft inner cover over which a fixed knife seat is bridged, a movable knife seat being bridged over the fixed knife seat, a movable knife being connected with a front end of the movable knife seat, the movable knife seat being driven by a driving arm to stably axially slide on the fixed knife seat, whereby after the movable knife hooks a stitching thread, the movable knife intersects the fixed knife to shear off the stitching thread, the knife track adjustment structure comprising:

(a) a guide seat bridged over the lower shaft inner cover, upper and a lower ends of the guide seat being locked on the lower shaft inner cover, whereby the fixed knife seat and a middle section of the movable knife seat bridged over the fixed knife seat are permitted to slide between the guide seat and the lower shaft inner cover, a guide spacer ring being disposed under the middle section of the guide seat, the guide spacer ring being sequentially passed through a first guide slot of the movable knife seat and a guide slot of the fixed knife seat; and (b) a swing arm, a first end of the swing arm being fitted on an eccentric adjustment spacer ring which has a first shaft section fixedly connected with the lower shaft inner cover and a second shaft section axially eccentrically disposed at the top end of the first shaft section, the second shaft section being pivotally connected with the first end of the swing arm, a spacer ring being connected with the bottom of a second end of the swing arm, the spacer ring being sequentially passed through a second guide slot of the movable knife seat and pivotally connected on the fixed knife seat, a spring being compressed between the swing arm and the lower shaft inner cover to help in restoring the fixed knife seat and movable knife seat.

5. The knife track adjustment structure of the thread cutter of the sewing machine as claimed in claim 4, wherein the first shaft section is a bolt or spacer ring eccentrically axially fitted through the eccentric adjustment spacer ring.

* * * * *